US005802191A

United States Patent [19]

Guenther

[11] Patent Number: 5,802,191

[45] Date of Patent: Sep. 1, 1998

[54] LOUDSPEAKERS, SYSTEMS, AND COMPONENTS THEREOF

[76] Inventor: Godehard A. Guenther, 75 Folsom St., San Francisco, Calif. 94105

[21] Appl. No.: 369,736

[22] Filed: Jan. 6, 1995

[51] Int. Cl.[6] ..... H04R 25/00

[52] U.S. Cl. ..... 381/188; 381/186; 381/192; 381/199; 381/203; 381/205; 181/147; 181/163

[58] Field of Search ..... 381/199, 201, 381/202, 205, 192, 196, 197, 182, 186; 181/147, 163

[56] References Cited

U.S. PATENT DOCUMENTS

| | | | |
|---|---|---|---|
| 3,067,366 | 12/1962 | Hofman | 381/201 |
| 4,122,315 | 10/1978 | Schroeder et al. | 381/186 |
| 4,401,857 | 8/1983 | Morikawa | 381/182 |
| 4,472,604 | 9/1984 | Nakamura et al. | 181/171 |
| 4,477,699 | 10/1984 | Wada et al. | 381/202 |
| 4,492,826 | 1/1985 | Chiu | 381/182 |
| 4,552,242 | 11/1985 | Kashiwabara | 381/182 |
| 4,565,905 | 1/1986 | Nation | 381/186 |
| 4,783,824 | 11/1988 | Kobayashi | 381/195 |
| 4,821,331 | 4/1989 | Murayama et al. | 381/182 |
| 4,965,837 | 10/1990 | Murayama et al. | 381/186 |
| 5,040,221 | 8/1991 | Edwards et al. | 381/194 |
| 5,390,257 | 2/1995 | Oslac et al. | 381/199 |
| 5,548,657 | 8/1996 | Fincham | 381/182 |
| 5,583,945 | 12/1996 | Iijima et al. | 381/199 |

*Primary Examiner*—Curtis Kuntz
*Assistant Examiner*—Rexford N. Barnie
*Attorney, Agent, or Firm*—David J. Powsner

[57] ABSTRACT

Improved loudspeakers, systems and components are adapted to interconnect with many forms of communication media. In one embodiment, a speaker is mountable within a receptacle. The speaker includes a magnetic driver and a diaphragm mounted to a frame. The frame includes a mounting member extending from a surface of the frame behind the flange plane. The mounting member is engagable in a notch formed in the receptacle for securing the speaker within the receptacle. In another embodiment, a low-profile loudspeaker has a front-mounted magnetic driver disposed within a cone-shaped acoustic diaphragm. The magnetic driver includes a first rare earth magnet centrally disposed within an electromagnetic shielding material. In another embodiment, a low-profile, two-way loudspeaker includes a cone-shaped diaphragm and a dome-shaped (tweeter) diaphragm. A front-mounted magnetic driver comprises first and second rare earth magnets each centrally disposed within electromagnetic shielding material. The driver and cone-shaped diaphragm are mounted to a speaker frame. The tweeter diaphragm is mounted onto the driver coaxially and substantially coplanar with a forward edge of the cone-shaped diaphragm.

16 Claims, 6 Drawing Sheets

LOUDSPEAKERS, SYSTEMS, AND COMPONENTS THEREOF

BACKGROUND OF THE INVENTION

The invention relates generally to the field of loudspeakers. In particular, the invention concerns improved loudspeakers, systems and components thereof.

A large percentage of loudspeakers used in audio systems are electrodynamic speakers. Such speakers employ a magnetic driver to produce movement of a diaphragm (typically cone or dome-shaped), which in turn causes sound.

A typical loudspeaker includes a frame upon which components are mounted. The frame provides a means for fastening the speaker to an enclosure or a receptacle. The frame, which is sometimes called the basket, has cut-outs in its side walls so air can freely circulate around a cone-shaped diaphragm. The loudspeaker driver includes a fixed magnet and voice coil. The magnet may be mounted to the rear of the frame behind the diaphragm. The voice coil is disposed adjacent the magnet and includes a bobbin. The bobbin is attached to the diaphragm.

In operation, electrical audio signals from an amplifier are applied to the voice coil producing a varying electromagnetic field around the coil. The electromagnetic field interacts with the magnetic field produced by the magnet. The magnet is securely fixed to the frame and the voice coil is movable, so the voice coil moves as the two fields interact. Because the voice coil is coupled to the diaphragm via the bobbin, its movement causes the diaphragm to vibrate. The vibration of the diaphragm causes air around the speaker to pressurize and depressurize, producing sound waves in the air.

Sound waves are emitted from both the front and rear of the speaker diaphragm. The waves emanating from the rear of an unmounted speaker can cause total or partial cancellation of the generated sound waves. To make speakers more efficient and improve sound quality, speakers are usually mounted within an enclosure.

A basic type of speaker enclosure is a sealed box structure. The structure is typically formed of wood or particle board and provides a sealed volume with air trapped inside. The speaker is positioned in an opening in the structure. The speaker frame has a flange with mounting holes formed therein. The speaker is positioned so that the flange is flush with one of the walls. Mounting screws can be inserted through the flange holes into the structure wall to secure the speaker within the sealed structure. The structure confines the rear pressure waves, thereby preventing interaction with the front waves resulting in better sound quality.

Speakers can be divided into three categories: woofer, midrange and tweeter. The woofer speaker reproduces low frequency (bass) sound ranging from about 20 to 3000 Hz. The midrange speaker reproduces a broad spectrum of sound, typically from about 1000 Hz to 10 kHz. The tweeter speaker reproduces high frequency (treble) sound ranging from about 4 to 20 kHz.

SUMMARY OF THE INVENTION

The present invention features improved loudspeakers, systems and components adapted to interconnect with various forms of communication media including television and video, radio and high-fidelity, computer and telephone and local intercoms and networks.

In one embodiment, the invention features a loudspeaker mountable within a receptacle or enclosure. The speaker includes an acoustic diaphragm, which may be cone or dome shaped, and a magnetic driver. The diaphragm and driver are mounted to a frame. The frame may be basket-shaped and includes a ring-shaped flange defining a flange plane. The frame also includes a mounting member extending from the frame behind the flange plane. The receptacle has a notch or groove disposed along an inner surface. The mounting member, which may be a V-shaped paw or the like, is engagable in the notch for securing the speaker within the receptacle.

In another embodiment, the invention features a method of mounting a loudspeaker. The method includes providing a loudspeaker and a receptacle as described above. The method also includes inserting the loudspeaker into the receptacle such that the mounting member is coplanar with the notch disposed along the inner surface of the receptacle. The method further includes rotating the loudspeaker until the mounting member engages the notch, thereby securing the loudspeaker within the receptacle.

The aforementioned embodiments provide several advantages over the state of the art. For example, the invention permits installation of a (nominal) X inch speaker in a (nominal) X–1 inch opening. This objective is achieved by relocating the mounting member. In contrast to typical flange or bayonet mounting schemes in which the mounting member is coplanar with the flange, the mounting member lies well behind the mounting flange in the present invention. The frame is tapered behind the flange, so the mounting member is located at diameter smaller than the speaker opening itself. Thus, the diaphragm is the largest visible component, and large flanges with mounting screws are not needed.

In another embodiment, the invention features a low-profile woofer loudspeaker having a front-mounted magnetic driver disposed within a cone-shaped acoustic diaphragm. The magnetic driver includes a first rare earth magnet (e.g., neodymium boron) centrally disposed within an electromagnetic shielding material (e.g., low carbon steel). The driver and diaphragm are mounted to the speaker frame. More specifically, the driver is front-mounted to an inner surface of the frame such that the driver is disposed within the cone-shaped diaphragm. The driver may further include a second rare earth magnet disposed within an electromagnetic shielding material, spaced from the first magnet and aligned 180 degrees out of phase relative to the first magnet.

The above described embodiment utilizes a state-of-the-art shielded magnetic driver, resulting in a powerful, shallow, lightweight woofer loudspeaker. The speaker has a broad range of applications including video, multimedia, auto stereo and in-wall systems.

In another embodiment, a low-profile two-way loudspeaker includes a cone-shaped acoustic diaphragm and a second acoustic diaphragm. The speaker also includes a front-mounted magnetic driver comprising first and second rare earth magnets (e.g., neodymium boron) each centrally disposed within electromagnetic shielding material (e.g., low carbon steel). The driver and cone-shaped diaphragm are mounted to a speaker frame. More specifically, the driver is front-mounted to an inner surface of the frame and disposed within the cone-shaped diaphragm. The second diaphragm is mounted onto the driver coaxially and substantially coplanar with a forward edge of the cone-shaped diaphragm. The driver may also include a third magnet spaced from the first magnet and aligned 180 degrees out of phase relative to the first magnet. The third magnet serves as a "turbocharger" for the first magnet.* Preferably, the cone-shaped diaphragm transmits woofer frequencies and the second diaphragm transmits tweeter frequencies.

* to wit, it cancels the stray magnetic field and enhances the flux density in the gap of the magnetic circuit.

The previously described embodiment provide several advantages over the art. For example, the speaker includes a front-mounted shielded magnetic driver, resulting in a powerful, shallow, lightweight two-way loudspeaker having a broad range of applications including video, multimedia, auto stereo and in-wall systems. Another advantage is that since the second (tweeter) diaphragm is substantially coplanar relative to cone-shaped (woofer) diaphragm, the speaker provides almost perfect acoustic time alignment. Yet another advantage is that the second (tweeter) diaphragm is positioned in an obstruction free location resulting in a wide accurate listening area. Still another advantage is that the front-mounted magnetic driver is resource efficient as the physical size of the speaker is reduced by at least a factor of two and its weight by at least a factor of four over conventional speakers.

In another embodiment, the invention features a loudspeaker enclosure which provides an increased interior volume over enclosures known in the art having identical external dimensions. The enclosure includes a perforated layer shaped to define an inner volume of the enclosure. Preferably, perforations cover at least eighty percent of the surface area of the perforated layer. A honeycomb layer surrounds the perforated layer, and a semi-rigid layer surrounds the honeycomb layer. The foregoing material combination results in an enclosure having 33% more interior volume over conventional enclosures having the same external dimensions.

BRIEF DESCRIPTION OF THE DRAWINGS

The foregoing and other objects, features and advantages of the invention will become apparent from the following more particular description of preferred embodiments of the invention, as illustrated in the accompanying drawings. The drawings are not necessarily to scale, emphasis instead being placed on illustrating the principles of the present invention.

FIG. 10 is an illustration of a loudspeaker enclosure in accordance with the invention.

FIG. 11 is a perspective view of a wall of the loudspeaker enclosure of FIG. 10.

DETAILED DESCRIPTION

The invention features improved loudspeakers, systems and components capable of interconnection with various forms of communication media including television and video, radio and high-fidelity, computer and telephone and local intercoms and networks.

Figure 1:
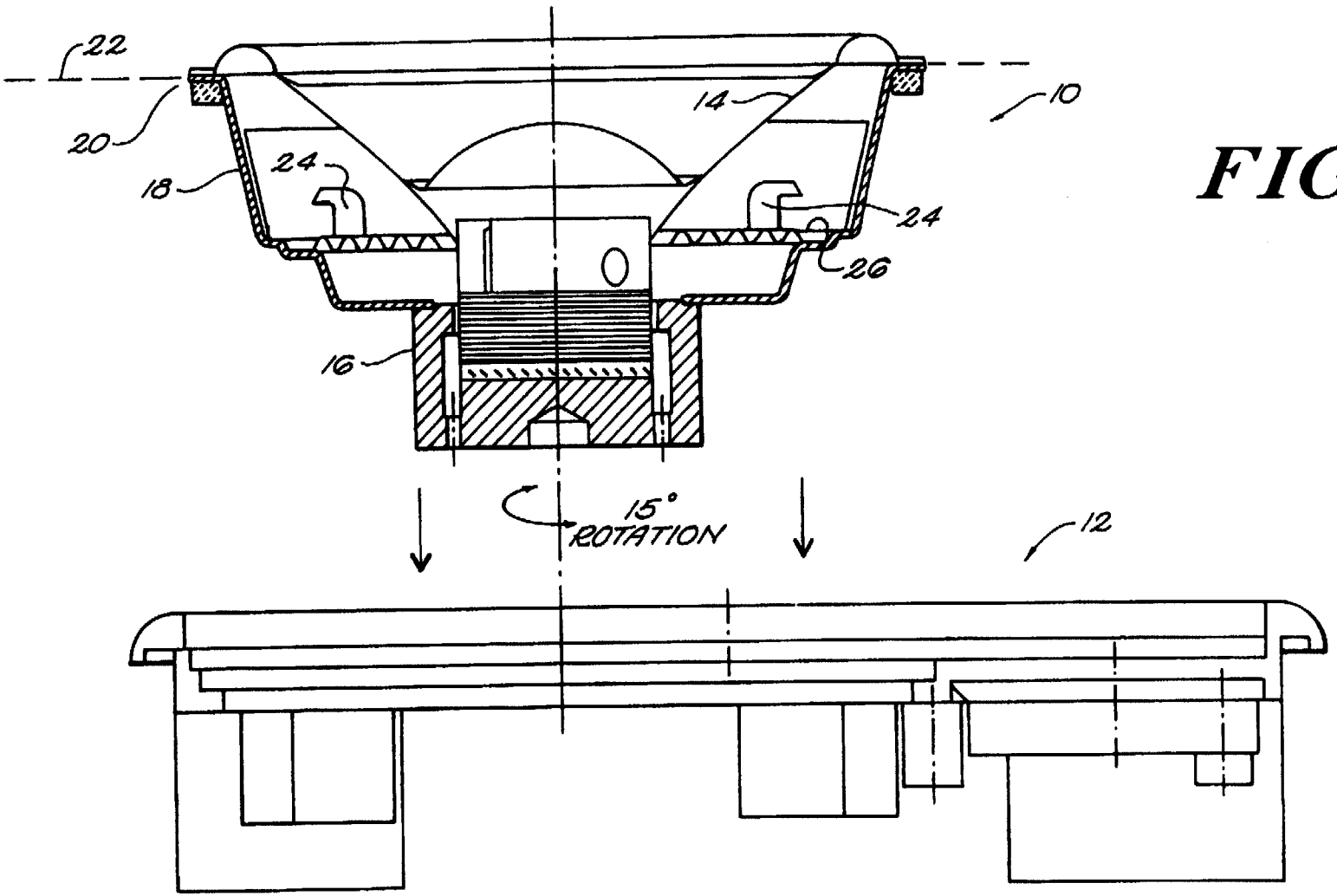
FIG. 1 is a cross-sectional view of the present mounting system including a woofer loudspeaker mountable within a receptacle.
Figure 2:
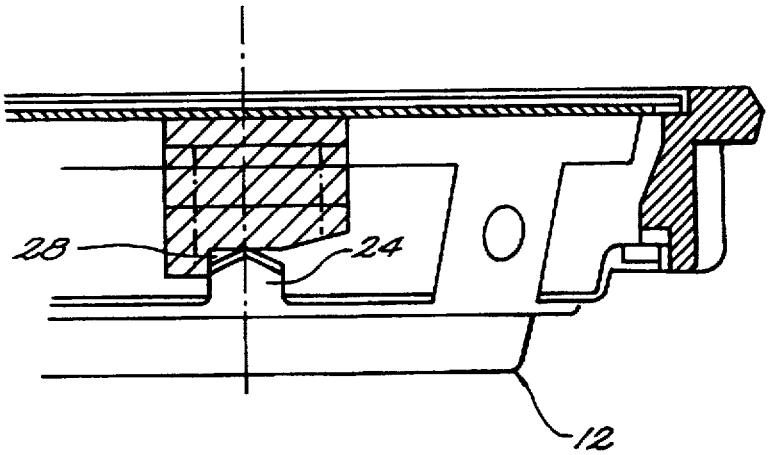
FIG. 2 is an enlarged partial cross-sectional view of the woofer loudspeaker of FIG. 1 physically mounted within the receptacle.

Referring to FIG. 1, one embodiment of the invention features a (woofer) loudspeaker 10 mountable within a receptacle 12. As shown, the speaker 10 includes a cone-shaped acoustic diaphragm 14 and a magnetic driver 16. The diaphragm 14 and driver 16 are mounted to a frame 18. The frame is generally basket-shaped and includes a ring-shaped flange 20 defining a flange plane 22. The frame 18 also includes at least one mounting member 24 extending from a section 26 of the frame behind (or below) the flange plane 22. The mounting member 24 may be a V-shaped paw or the like. Referring to FIG. 2, the mounting member 24 is engagable in a notch or groove 28 formed along an inner surface of the receptacle 30 for securing the speaker within the receptacle. The receptacle may be disposed in an enclosure 60 (FIG. 5) or an enclosure located in an auto, a lighting fixture or a wall.

The invention further includes a push-and-rotate method for securing the speaker 10 within the receptacle 12. The method includes inserting the speaker 10 into the receptacle 12 such that each mounting member 24 is coplanar with a respective notch 28 located along the inner surface of the receptacle 30. The method further includes rotating the speaker 10 until each mounting member 24 engages each notch, thereby locking the speaker 10 in the receptacle 12. For example, the speaker 10 may need be rotated about 15 degrees to secure each member 24 in a respective notch 28. Also, a foam gasket (not shown) located at the frame-receptacle interface serves as a seal and tensioning means.

Figure 3:
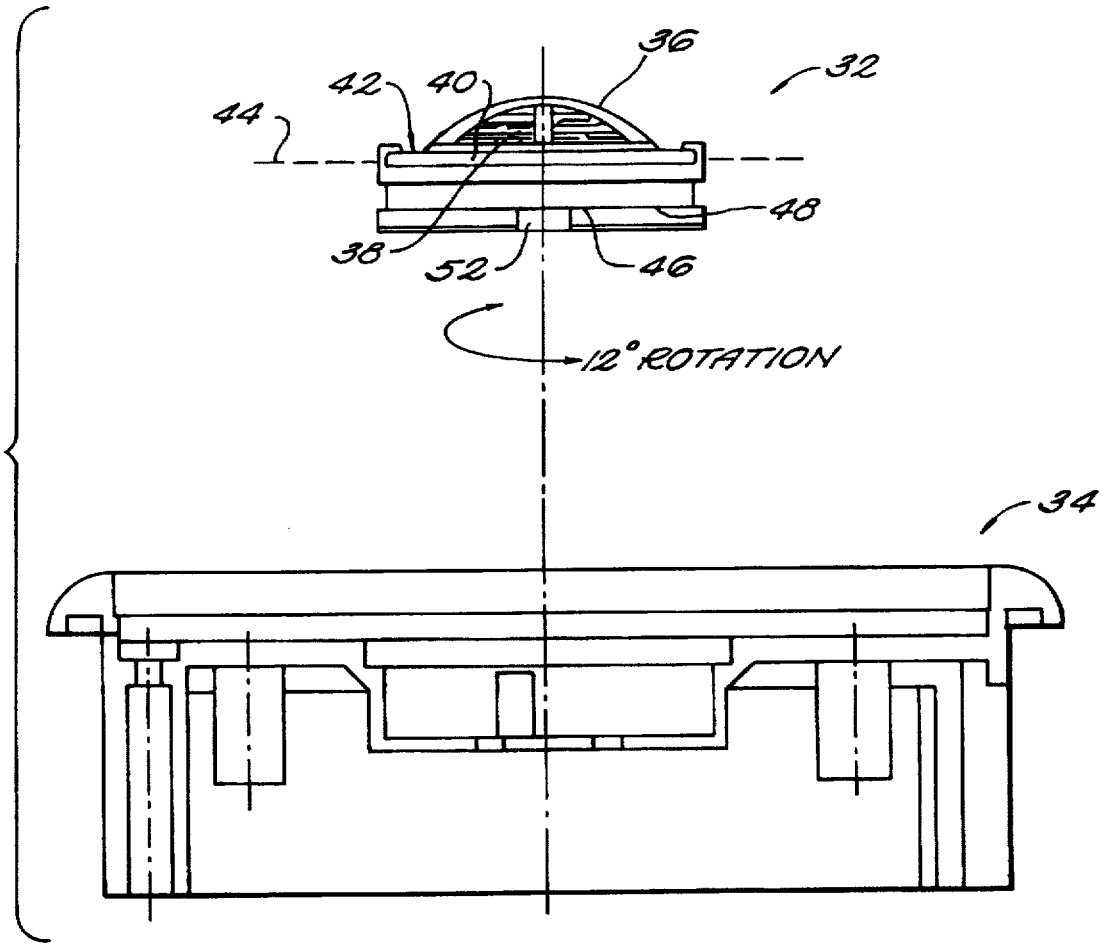
FIG. 3 is another cross-sectional view of the present mounting system including a tweeter loudspeaker mountable within a receptacle.
Figure 4:
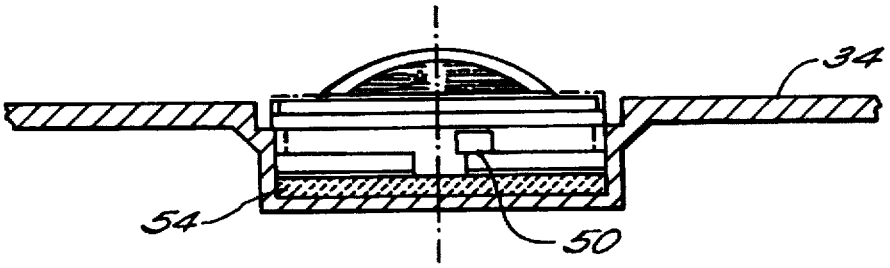
FIG. 4 is a cross-sectional view of the tweeter loudspeaker of FIG. 3 physically mounted within the receptacle.

Referring to FIG. 3, the invention also features a (tweeter) loudspeaker 32 mountable within a receptacle 34. As shown, the speaker 32 includes a dome-shaped acoustic diaphragm 36 and a magnetic driver 38. The diaphragm 36 and driver 38 are mounted to a frame 40, which includes a ring-shaped flange 42 defining a flange plane 44. The frame 40 also includes at least one mounting member 46 extending from a section 48 of the frame behind (or below) the flange plane 44. Referring to FIGS. 3–4, each mounting member 46 is engagable in a respective notch (or groove) 50 formed along an inner surface of the receptacle 34. The frame 40 also includes at least one groove 52 which is engagable with a respective post (not shown) on the receptacle 34. A foam gasket 54 located at the frame-receptacle interface serves as a seal and tensioning means. The receptacle may be disposed in an enclosure 60 (FIG. 5) or an enclosure located in an auto, a lighting fixture or a wall.

Figure 5:
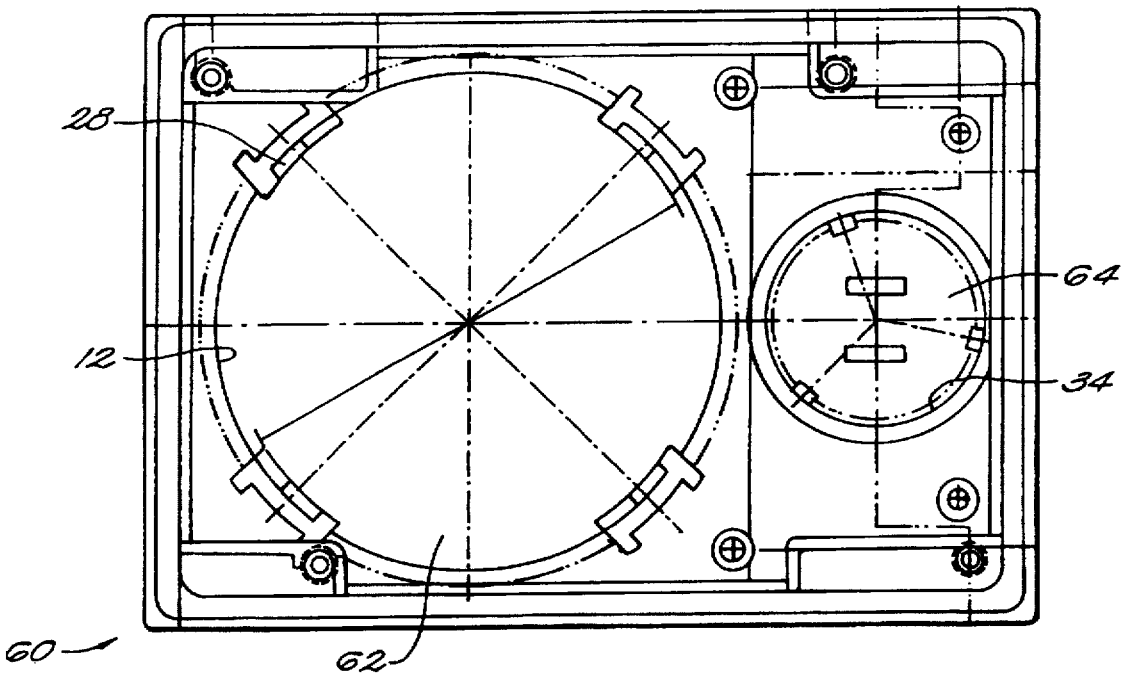
FIG. 5 is a top view of an enclosure in which both the woofer of FIG. 1 and the tweeter of FIG. 3 may be mounted.

Referring to FIG. 5, an enclosure 60 includes the woofer receptacle 12 and the tweeter receptacle 34. The enclosure 60 defines a first opening 62 and a second opening 64. The woofer receptacle 12 is mounted adjacent a first opening 62 and the tweeter receptacle 34 is mounted adjacent the second opening 64.

The aforementioned embodiments of the invention permit installation of a (nominal) X inch speaker in a (nominal) X−1 inch opening. This feature is achieved by relocating the mounting member to a location well behind the plane defined by the mounting flange. Since the frame is somewhat tapered behind the flange, the mounting member is located at diameter smaller than the speaker opening itself. Thus, the diaphragm is the largest visible component, and large flanges with mounting screws are not employed.

Further, the mounting scheme featured in the aforementioned embodiments reduces the mounting area of a speaker to its minimal functional size reducing the diameter by about one inch or more. Consequently, larger more powerful speakers can be installed in smaller areas, and multiple components can be installed closer together for improved sound quality. No additional hardware is needed. This enhances serviceability and reduces installation time and cost, while minimizing the visual intrusion of the speaker components. Moreover, it permits sound contractors to visually complete sound systems by investing only in inexpensive receptacles and not installing the actual speakers until the end of the process.

Figure 6:
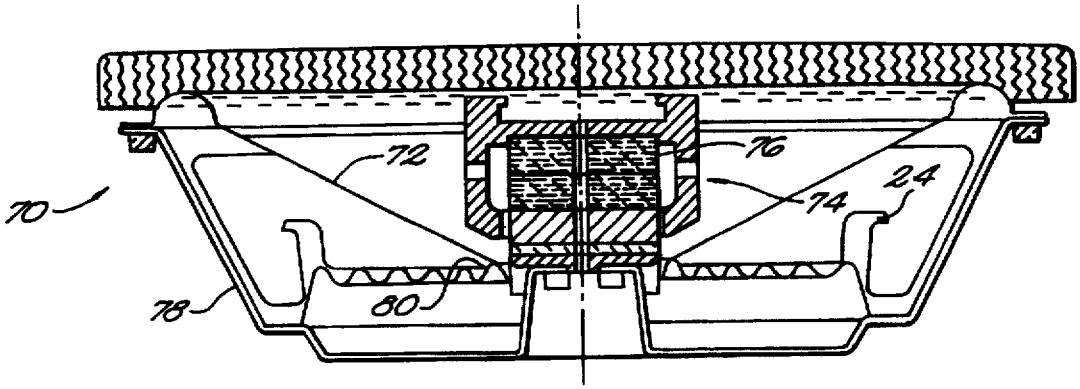
FIG. 6 is a cross-sectional view of a woofer loudspeaker having a front-mounted magnetic driver in accordance with the invention.

Referring to FIG. 6, another embodiment of the invention features a low-profile woofer loudspeaker 70 having a front-mounted magnetic driver 72 disposed within a cone-shaped acoustic diaphragm 74. The magnetic driver 72 includes a first rare earth magnet 76, preferably comprising neodymium boron. As shown, the first magnet may be a pair of stacked magnet members. The magnet 76 is centrally disposed within an electromagnetic shielding material 78 comprising low carbon steel. The driver also includes a voicecoil assembly 88 (FIG. 7) comprising light weight oxide-insulated edge-wound aluminum voice coils. The driver 72 and diaphragm 74 are mounted to the speaker frame 78. More specifically, the driver 72 is front-mounted to an inner surface 80 of the frame such that the driver is disposed within the cone-shaped diaphragm 72. At least one mounting member 24 may be mounted to the frame.

Figure 7:
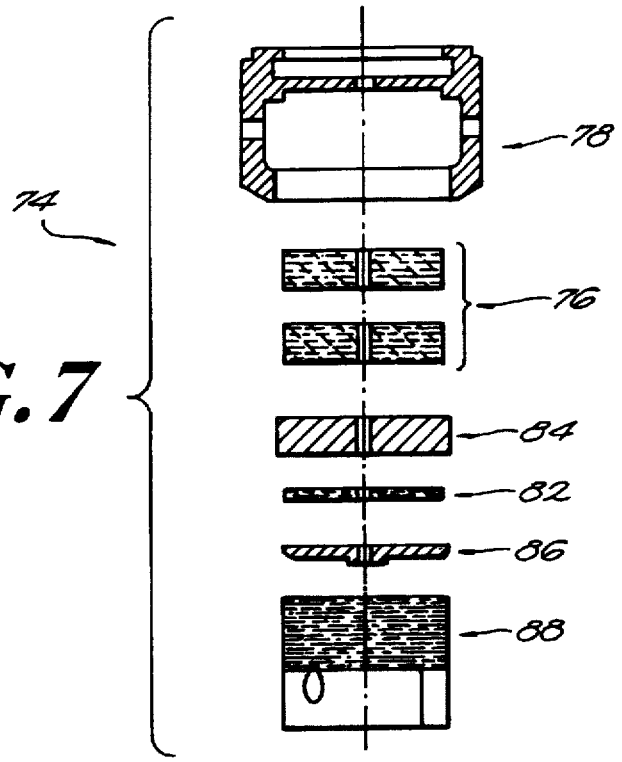
FIG. 7 is a cross-sectional view of a magnetic driver in accordance with the invention.

The magnetic driver 74 is shown in detail in FIG. 7. As shown, the driver 74 includes a first rare earth magnet 76 formed from a pair of stacked magnet members, preferably comprising neodymium boron. An electromagnetic shielding material 78 comprising low carbon steel surrounds the magnet 76. The driver 74 may further include a second rare earth magnet 82 separated from the magnet 76 by a top plate 84. The second magnet 82, preferably comprising neodymium boron, is aligned 180 degrees out of phase relative to the first magnet 76. As such, the magnet 82 serves as a "turbocharger" for the first magnet 76. A second top plate 86 separates the magnet 82 from the voicecoil assembly 88.

Figure 8:
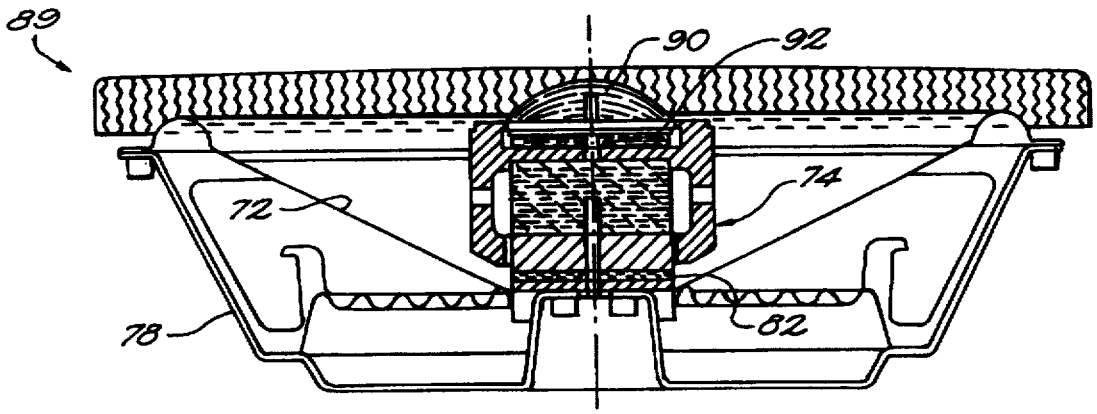
FIG. 8 is a cross-sectional view two-way loudspeaker having a front-mounted magnetic driver in accordance with the invention.
Figure 9:
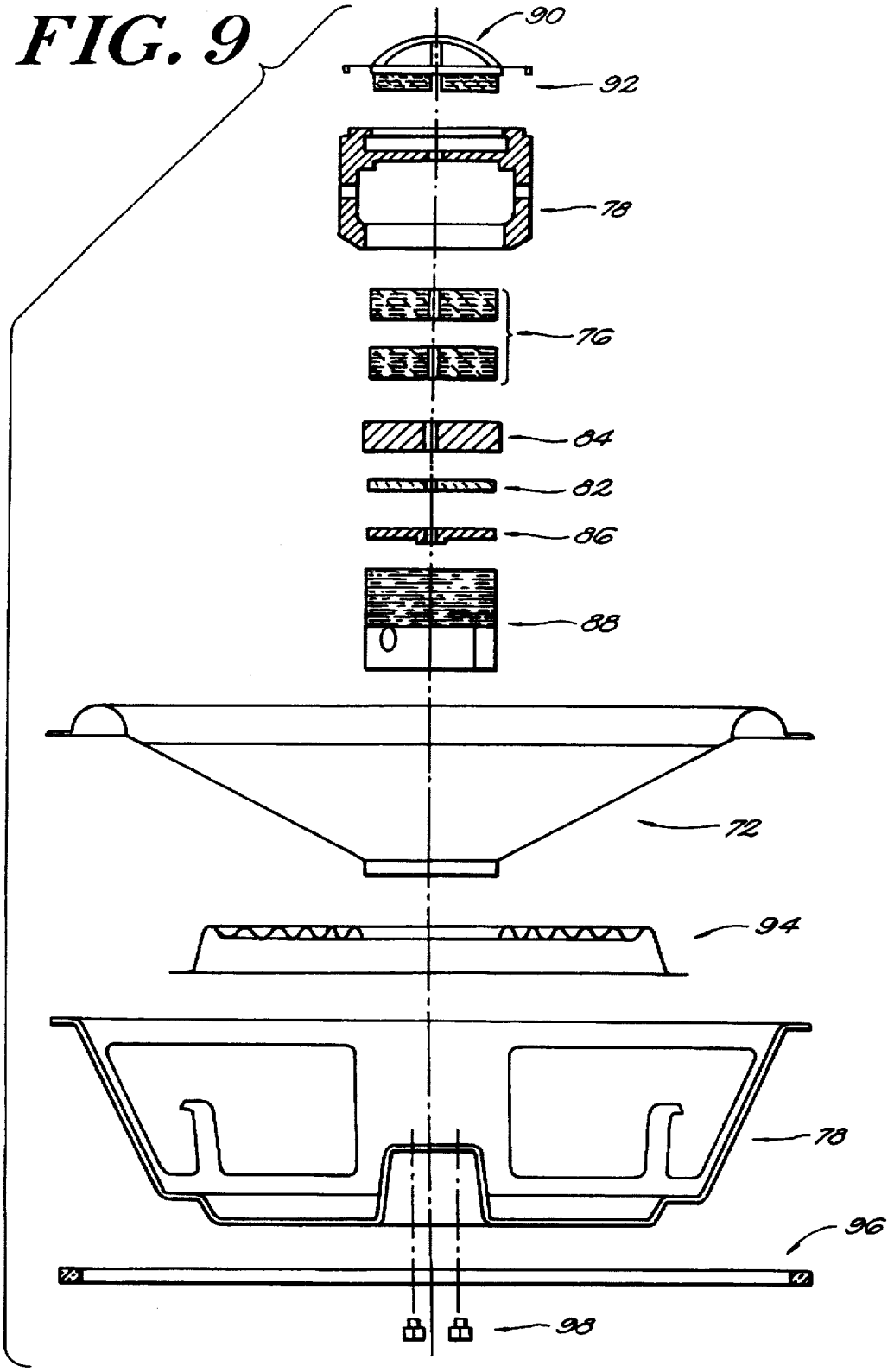
FIG. 9 is a cross-sectional view of the magnetic driver of the two-way loudspeaker of FIG. 8.

In another embodiment, a low-profile two-way loudspeaker 89 includes the woofer loudspeaker structure described above along with a tweeter assembly mounted onto the front-mounted woofer driver. Referring to FIGS. 8–9, the two-way loudspeaker has a cone-shaped woofer diaphragm 72 coupled to a suspension 94 and a dome-shaped tweeter diaphragm 90. The front-mounted magnetic driver 74 is mounted to the frame 78 by a foam gasket 96 and screws 98. The driver 74 comprises a first rare earth (woofer) magnet 76, preferably comprising neodymium boron. This magnet is centrally disposed within electromagnetic shielding material 78 comprising low carbon steel. The driver 74 is front-mounted to an inner surface of the frame 78 and disposed within the cone-shaped diaphragm 72. The tweeter diaphragm 90 is mounted, via a second (tweeter) magnet 92, onto the driver 74 coaxially and substantially coplanar with a forward edge of the cone-shaped diaphragm 72. The driver 74 may also include a third (woofer) magnet 82 aligned 180 degrees out of phase relative to the first magnet 76. As noted previously, the second magnet 82 serves as a "turbocharger" for the first magnet 82.

The speakers 70, 89 each include a front-mounted shielded magnetic driver, resulting in a powerful, shallow, lightweight loudspeaker having a broad range of applications including video, multimedia, auto stereo and in-wall systems. Referring to the two-speaker 89, there are substantial advantages including:

1) Acoustic stage stability and uniform polar response which is superior to the best conventional two-way systems.
2) A very shallow depth (e.g., two inches) because the conventional heavy magnet mounted behind the woofer cone is eliminated.
3) Since the dome is nearly flush with the rubber edge of the woofer, almost perfect acoustic time alignment is achieved.
4) The tweeter magnet also drives the woofer cone, so the added height and weight of an additional magnetic return path is eliminated.
5) The location of the tweeter is obstruction free for a wide accurate listening area.
6) In autos, the speaker permits door installation without inference with internal door elements.
7) The light weight of the speaker facilitates ex-factory auto installation. The high weight associated with conventional aftermarket hi-fi systems has proven unacceptable to many car manufacturers because it reduces the fuel economy. Further, the heavy drivers have been perceived as unacceptable passenger safety risk.
8) In commercial buildings, the light weight speaker allows safe and inexpensive ceiling and ceiling-tile installations. The excellent dispersion reduces the total number of speakers required while improving intelligibility for safety (department stores, restaurants, museums, airports etc.) and fidelity of sound.
9) In the home, the shallow depth of the speaker permits installation in 2"×4" stud walls while maintaining proper insulation behind.
10) In home video theaters which require at least six speaker systems, the speakers can be fully flush integrated into walls or ceilings including the mandatory sub woofer bass system.

Referring to FIGS. 10–11, the invention also features a loudspeaker enclosure 100 which provides an increased interior volume over existing enclosures having identical external dimensions. The enclosure 100 includes a perforated layer 102 shaped to define an inner volume of the enclosure. The perforated layer 102 may be formed aluminum or any other suitable material. Preferably, the perforations 103 cover at least eighty percent of the surface area of the perforated layer. A honeycomb layer 104 surrounds the perforated layer 102, and a semi-rigid layer 106 surrounds the honeycomb layer. The honeycomb layer 104 may be formed of paper or any other suitable material. The semi-rigid layer may be formed of a metallic material or the like. The foregoing material combination results in an enclosure having 33% more interior volume over conventional enclosures having the same external dimensions. The additional volume is achieved because the interior layers act as a virtual wall.

Equivalents

While various embodiments of the invention have been set forth in detail, it should be understood that the above description is intended as illustrative rather than limiting and that many variations to the described embodiments will be apparent to those skilled in the art. The invention is to be described, therefore, not by the preceding description, but by the claims that follow.

What is claimed is:

1. A loudspeaker comprising:

a cone-shaped acoustic diaphragm;

a driver including first and second rare earth magnets at least one of which is centrally disposed within electromagnetic shielding material;

a frame to which the driver and cone-shaped diaphragm are mounted, wherein the driver is mounted to an inner surface of the frame such that the driver is disposed within the cone-shaped diaphragm;

a second acoustic diaphragm mounted onto the driver coaxially and substantially coplanar with a forward edge of the cone-shaped diaphragm.

2. A loudspeaker as claimed in claim 1 wherein the driver is capable of providing woofer and tweeter frequency range signals.

3. A loudspeaker as claimed in claim 1 wherein the rare earth magnets comprise neodymium boron.

4. A loudspeaker as claimed in claim 1 wherein the electromagnetic shielding material comprises low-carbon steel.

5. A loudspeaker as claimed in claim 1 wherein the driver further comprises a third rare earth magnet disposed within electromagnetic shielding material, spaced from the first rare earth magnet and aligned 180 degrees out of phase relative to the first rare earth magnet.

6. A loudspeaker as claimed in claim 1 wherein the electromagnetic shielding material is formed as a unitary piece.

7. A woofer loudspeaker mountable within a receptacle comprising:

a cone-shaped acoustic diaphragm;

a driver including a first rare earth magnet centrally disposed within an electromagnetic shielding material;

a frame to which the driver and diaphragm are mounted, wherein the driver is mounted to an inner surface of the frame such that the driver is disposed within the cone-shaped diaphragm, such that the frame includes a flange which defines a flange plane and a mounting member extending from a surface of the frame behind the flange plane, wherein the member is engagable in a notch disposed in a inner surface of a receptacle so as to secure the loudspeaker within the receptacle.

8. A woofer loudspeaker as claimed in claim 7 wherein the first rare earth magnet comprises neodymium boron.

9. A woofer loudspeaker as claimed in claim 7 wherein the electromagnetic shielding material comprises low-carbon steel.

10. A woofer loudspeaker as claimed in claim 7 wherein the driver further includes a second rare earth magnet, spaced from the first rare earth magnet and aligned 180 degrees out of phase relative to the first rare earth magnet.

11. A loudspeaker comprising:

a cone-shaped acoustic diaphragm;

a driver including first and second rare earth magnets each centrally disposed within electromagnetic shielding material;

a frame to which the driver and cone-shaped diaphragm are mounted, wherein the driver is mounted to an inner surface of the frame such that the driver is disposed within the cone-shaped diaphragm, such that the frame includes a flange which defines a flange plane and a mounting member extending from a surface of the frame behind the flange plane, wherein the member is engagable in a notch disposed in a inner surface of a receptacle so as to secure the loudspeaker within the receptacle;

a second acoustic diaphragm mounted onto the driver coaxially and substantially coplanar with a forward edge of the cone-shaped diaphragm.

12. A loudspeaker as claimed in claim 11 wherein the driver is capable of providing woofer and tweeter frequency range signals.

13. A loudspeaker as claimed in claim 11 wherein the rare earth magnets comprise neodymium boron.

14. A loudspeaker as claimed in claim 11 wherein the electromagnetic shielding material comprises low-carbon steel.

15. A loudspeaker as claimed in claim 11 wherein the driver further comprises a third rare earth magnet disposed within electromagnetic shielding material, spaced from the first rare earth magnet and aligned 180 degrees out of phase relative to the first rare earth magnet.

16. A loudspeaker as claimed in claim 11 wherein the electromagnetic shielding material is formed as a unitary piece.

* * * * *

UNITED STATES PATENT AND TRADEMARK OFFICE

CERTIFICATE OF CORRECTION

PATENT NO. : 5,802,191
DATED : September 1, 1998
INVENTOR(S) : Godehard A. Guenther It is certified that error appears in the above-identified patent and that said Letters Patent is hereby corrected as shown below:

Column 3,
Delete lines 66-67.

Column 4,
Delete lines 1-2.

Column 6,
Line 42, replace "FIGS. 10-11" with -- an embodiment not shown --.
Lines 43 and 45, delete "100".
Lines 46 and 47, delete "102".
Line 49, delete "103".
Lines 50 and 52, delete "104".
Line 51, delete "102" and "106".

Signed and Sealed this

Twenty-ninth Day of July, 2003

JAMES E. ROGAN
*Director of the United States Patent and Trademark Office*